US006557716B1

(12) United States Patent
Chan

(10) Patent No.: US 6,557,716 B1
(45) Date of Patent: May 6, 2003

(54) TRASH BAG HOLDER

(76) Inventor: Edmund Chan, 2114 Junction Ave., El Cerrito, CA (US) 94530

( * ) Notice: Subject to any disclaimer, the term of this patent is extended or adjusted under 35 U.S.C. 154(b) by 0 days.

(21) Appl. No.: 10/252,992

(22) Filed: Sep. 23, 2002

(51) Int. Cl.[7] ..... B65D 25/14

(52) U.S. Cl. ..... 220/9.4; 220/498.11; 220/908.1; 220/495.08

(58) Field of Search ..... 220/495.08, 495.11, 220/908.1, 9.4

(56) References Cited

U.S. PATENT DOCUMENTS 4,892,224 A * 1/1990 Graham ..... 141/391
5,419,452 A * 5/1995 Mueller et al. ..... 220/495.08
5,501,358 A * 3/1996 Hobday ..... 220/495.08
5,957,320 A * 9/1999 Boland ..... 220/495.08
6,474,495 B1 * 11/2002 Frei ..... 220/495.08

* cited by examiner

*Primary Examiner*—Joseph M. Moy

(57) ABSTRACT

Trash Bag Holder with a four sided, rigid paneled, open bottomed bag holding structure. Two opposing walls of the structure have die cut apertures near the top of the structure and flexible plastic panels that cover the cutouts that can removably retain portions of a plastic trash bag. The plastic panels each have an X shaped slit where a portion of a plastic bag can be pushed through each slit by the user. The plastic panels are attached to the walls by rivets or other standard attachment. The four side panels are attached at each adjoining edge by an integral hinge so that the panels can be folded onto each other to create a relatively flat configuration for storage and packaging.

2 Claims, 4 Drawing Sheets

TRASH BAG HOLDER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of bag holders and more specifically to a collapsible trash bag holding device.

Plastic trash bags have been in use for many years. They are traditionally made of low density polyethylene and are thin walled so that they need some means of support when being used.

Many trash bag retainers are available on the market today. They are traditionally rigid structures where the user inserts the bag and the bag is retained at its top portion, usually by folding over a portion of the top of the bag over the top perimeter of the holding structure.

Although the bag retaining structures that are available today are basically effective, they have a deficiency in that a portion of the top of the bag must be sacrificed to holding the bag up thereby reducing the trash holding capacity of the bag. Additionally, many trash holding structures a rigid and non collapsible therefore taking up considerable space when not in use or when packaged for sale in the marketplace.

BRIEF SUMMARY OF THE INVENTION

The primary object of the invention is to provide a trash bag holder that gives support to standard plastic trash bags.

Another object of the invention is to provide a trash bag holder that is collapsible.

Another object of the invention is to provide a trash bag holder that can retain the bag without need to sacrifice any of the top portion of the bag in the act of supporting the bag.

Another object of the invention is to provide a trash bag holder that securely holds a trash bag in the up and open position where the trash bag can be of various sizes and still be effectively held by the bag holder.

A further object of the invention is to provide a trash bag holder that is inexpensive to manufacture.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a Trash Bag Holder comprising: a four sided, rigid paneled, open bottomed bag holding device. Two opposing walls of said device have die cut apertures near the top of the structure and flexible plastic panels that cover said cutouts that can removably retain portions of said bag. The plastic panels each have an X shaped slit where a portion of said plastic bag can be pushed through each slit by the user. Said plastic panels are attached to said walls by means of rivets or other standard attachment means. The four side panels are attached at each adjoining edge by an integral hinge so that said panels can be folded onto each other to create a relatively flat configuration for storage and packaging.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
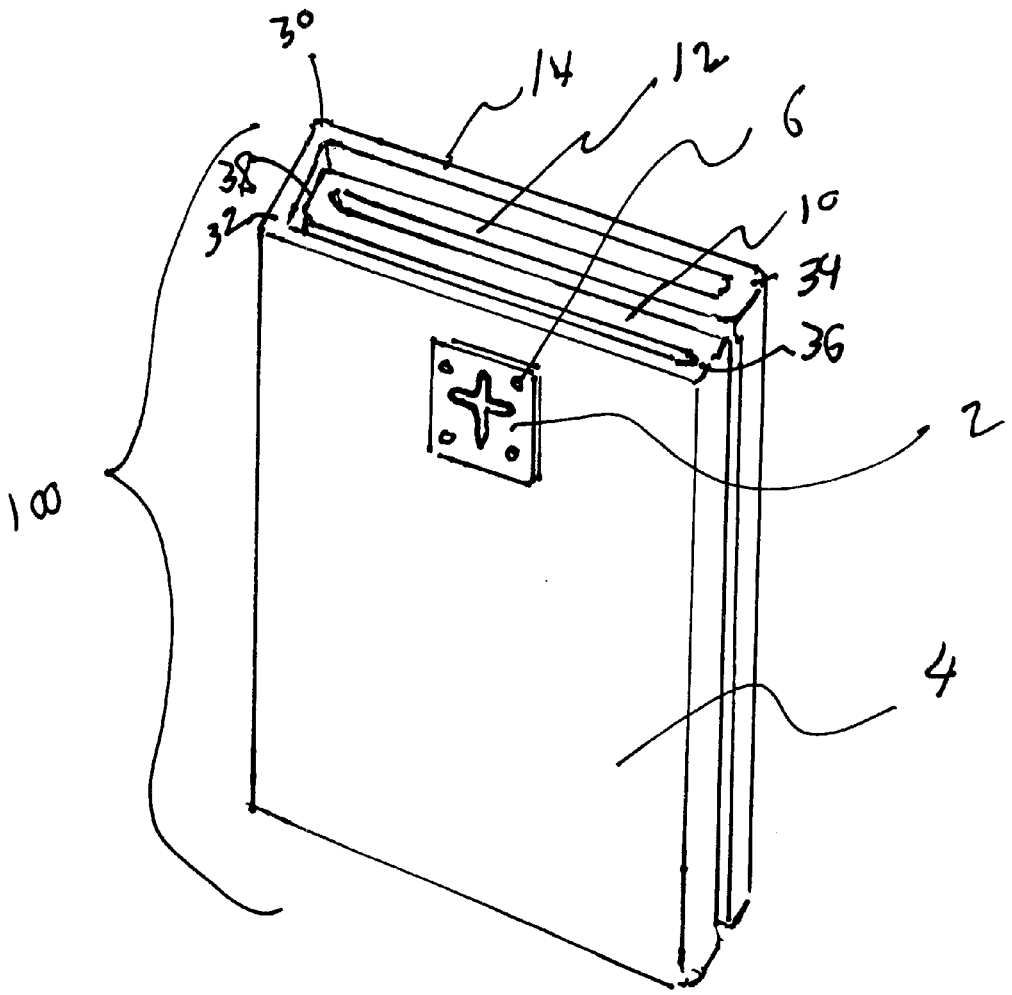
FIG. 1 is a perspective view of the invention in the collapsed position.
Figure 2:
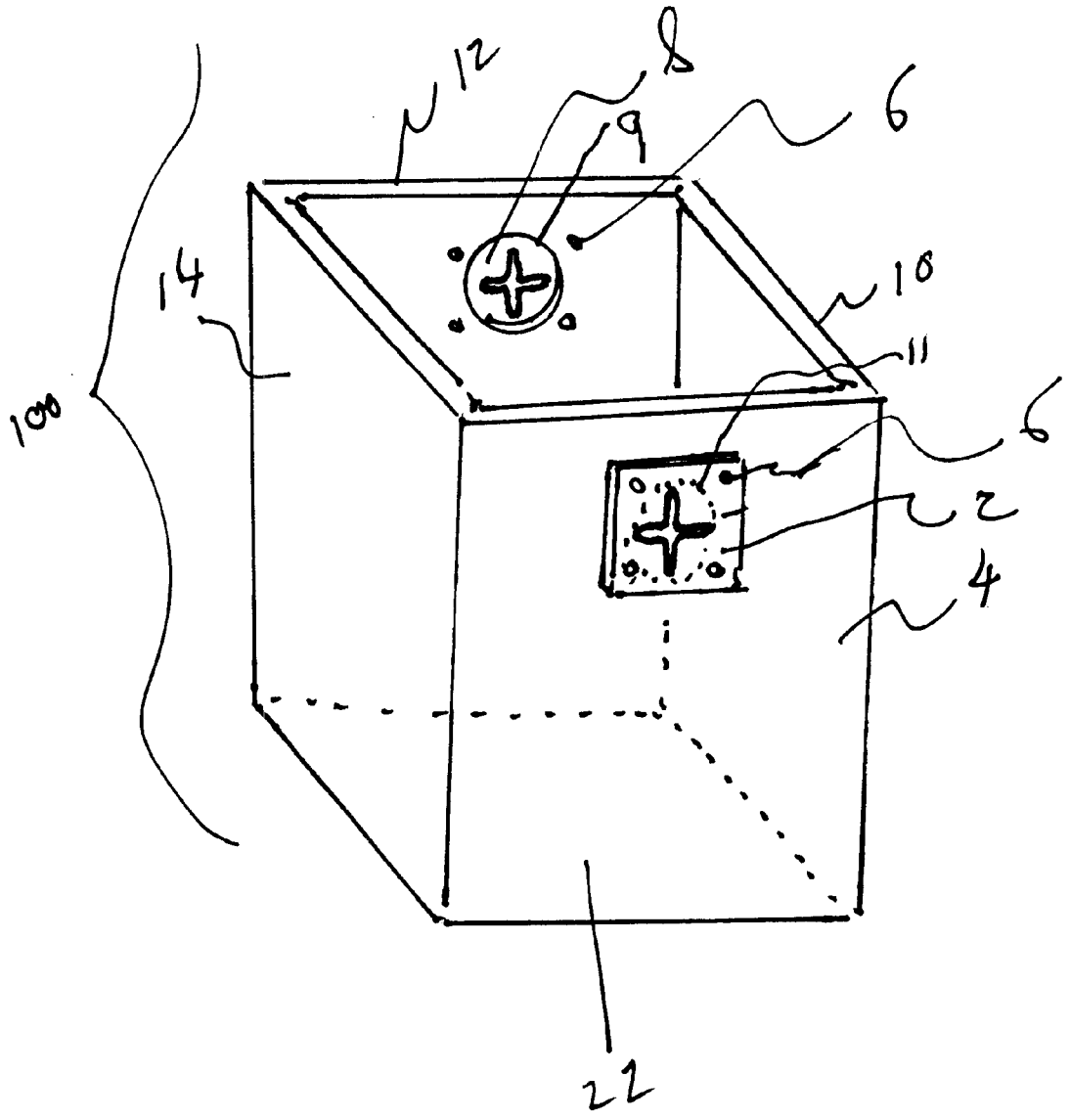
FIG. 2 is a perspective view of the invention in the open position.
Figure 3:
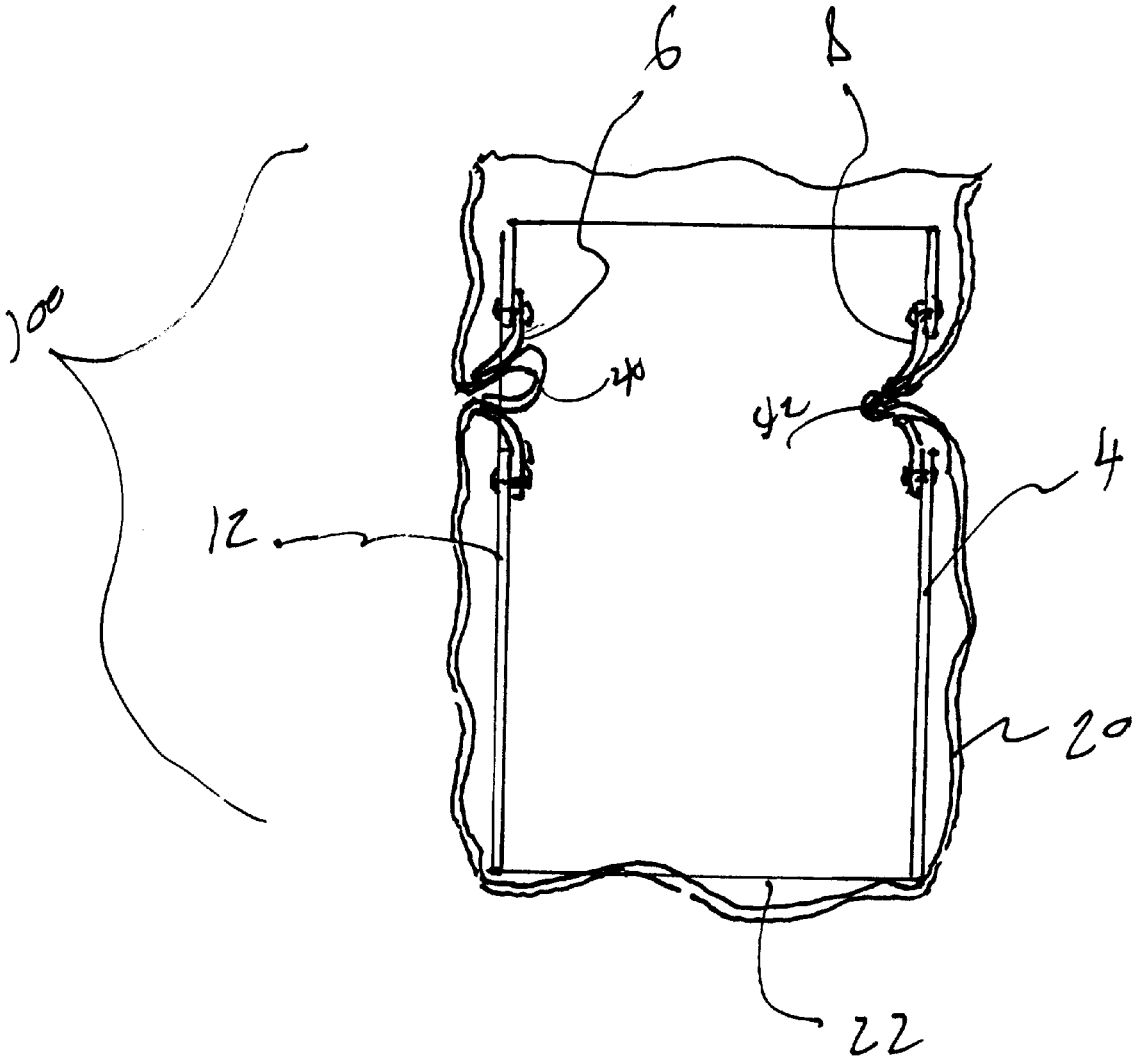
FIG. 3 is a side section view of the present invention.
Figure 4:
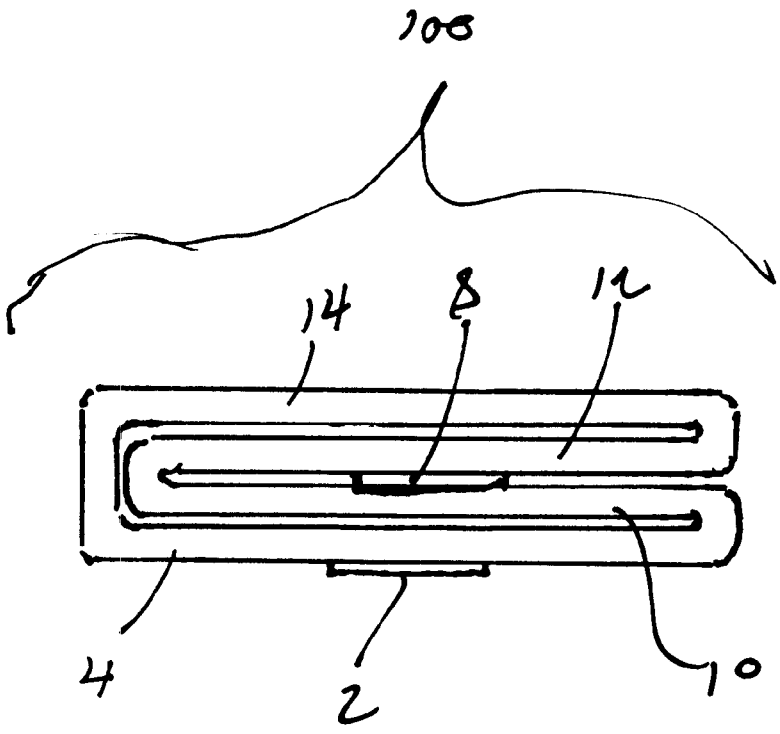
FIG. 4 is a top view of the present invention.

Referring now to FIG. 1 we see a perspective view of the bag holding device of the present invention 100 in the collapsed position. Rigid panels 4, 10, 12, 14 are attached to each other by integral hinge members 30, 32, 34, 36, 38. The panels are made of inexpensive, light weight, water resistant materials such as wax or plastic coated corrugated cardboard or corrugated plastic board. The corrugated board can be scored in the standard way to create the hinge members 30, 32, 34, 36, 38. FIG. 2 shows the present invention 100 in the open position. The open structure has no bottom 22. Two opposing panels 4, 12 have die cut apertures 11. Flat plastic panels 2, 8 are attached to cover apertures 9, 11 by rivets 6 or other standard attachment means. FIG. 3 shows a side section view of the present invention 100. A trash bag 20 is attached to bag holding panels 4, 12 when the user presses bag portions 40, 42 into flexible panels 6, 8 respectively. This allows the bag 20 to be supported without having to fold over a portion of the top of the bag over the top of the bag holding structure. Therefore, more of the bag 20 is available to the user for filling with trash and the like. FIG. 4 shows a top view of the present invention 100 in the closed position for compact storage of packaging. The above description and illustrations show that the present invention can effectively and easily hold up, and open, a trash bag regardless of its diameter or height.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Trash Bag Holder comprising:

a four sided, rigid paneled, open bottomed bag holding structure;

two opposing walls of said structure having die cut apertures near the top of the structure and flexible plastic panels that cover said cutouts that can removably retain portions of said bag;

said plastic panels each having an X shaped slit where a portion of said plastic bag can be pushed through each slit by the user;

said plastic panels attached to said walls by means of rivets or other standard attachment means; and said four side panels being attached at each adjoining edge by an integral hinge so that said panels can be folded onto each other to create a relatively flat configuration for storage and packaging.

2. Trash Bag Holder as claimed in claim 1 wherein said trash bag holder can effectively and economically hold up, and out, a trash bag regardless of the said trash bag's diameter or height.

* * * * *